US006087938A

United States Patent [19]

Gitelis et al.

[11] Patent Number: 6,087,938

[45] Date of Patent: Jul. 11, 2000

[54] OUTDOOR INTRUSION DETECTOR

[75] Inventors: Assaf Gitelis; Meir Gitelis, both of Bene Atarot, Israel

[73] Assignee: Nachshol Electronics Ltd., Bene Atarot, Israel

[21] Appl. No.: 09/153,204

[22] Filed: Sep. 15, 1998

[30] Foreign Application Priority Data

Sep. 17, 1997 [IL] Israel ..... 12179

[51] Int. Cl.[7] ..... G08B 13/18

[52] U.S. Cl. ..... 340/567; 250/342; 250/353; 250/DIG. 1; 340/539; 340/693.6; 340/693.8; 340/693.12

[58] Field of Search ..... 340/541, 565, 340/567, 539, 693.6, 693.8, 693.9, 693.12, 522; 250/353, 342, DIG. 1

[56] References Cited

U.S. PATENT DOCUMENTS

| | | | |
|---|---|---|---|
| 4,242,669 | 12/1980 | Crick | 340/567 |
| 4,258,255 | 3/1981 | Guscott | 250/221 |
| 4,447,726 | 5/1984 | Mudge et al. | 250/342 |
| 4,484,075 | 11/1984 | Kahl, Jr. et al. | 250/342 |
| 4,604,524 | 8/1986 | Kotlicki et al. | 250/342 |
| 4,660,024 | 4/1987 | McMaster | 340/522 |
| 4,709,153 | 11/1987 | Schofield | 250/353 |
| 4,710,750 | 12/1987 | Johnson | 340/522 |
| 4,725,768 | 2/1988 | Watanabe | 323/222 |
| 4,982,094 | 1/1991 | Matsuda | 250/342 |
| 5,077,549 | 12/1991 | Hershkovitz et al. | 340/567 |
| 5,084,696 | 1/1992 | Guscott et al. | 340/541 |
| 5,128,654 | 7/1992 | Griffin et al. | 340/567 |
| 5,296,707 | 3/1994 | Nozu | 250/353 |
| 5,440,292 | 8/1995 | Bedrosian | 340/567 |
| 5,587,701 | 12/1996 | Hess | 340/541 |
| 5,604,483 | 2/1997 | Giangardella et al. | 340/565 |

OTHER PUBLICATIONS

SRN–2000W–Wireless PIR, Super Red Wireless PIR, Visonic Ltd. Tel Aviv, 1991.

WR–200 Series, Wireless Receivers, Visonic Ltd. Tel Aviv, 1993.

MAX–16W, Computerized Multi–Function Wireless Alarm System, Visonic Ltd. Tel Aviv, 1995.

*Primary Examiner*—Thomas Mullen
*Attorney, Agent, or Firm*—Darby & Darby

[57] ABSTRACT

An intrusion detection assembly including an intrusion detector including an inner housing, a detector disposed within the inner housing and a lens for focusing light from outside the inner housing onto the detector, and an outer housing which is generally sealed from the outside and defines a window which is generally transparent to light which is detected by the detector, wherein the intrusion detector is spaced from the window so as to define a region of high sensitivity between the lens and the window which is sealed from the outside environment.

4 Claims, 13 Drawing Sheets

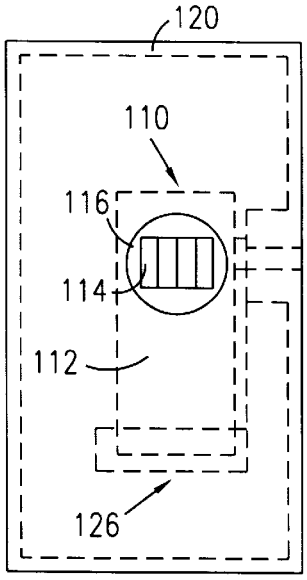
FIG. 2A
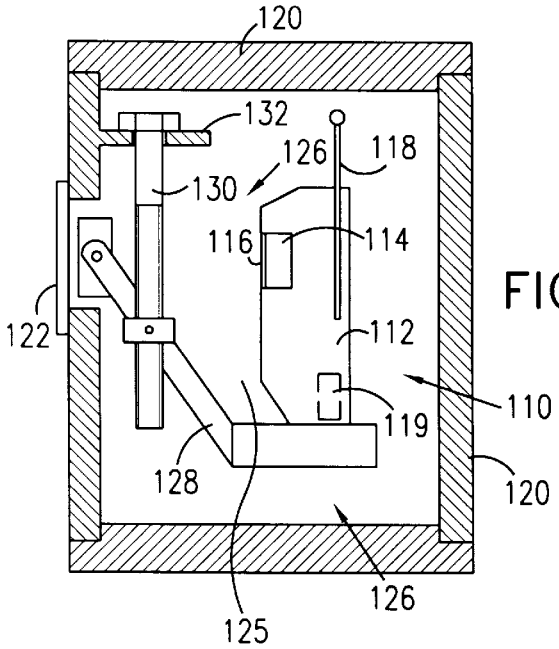
FIG. 2B
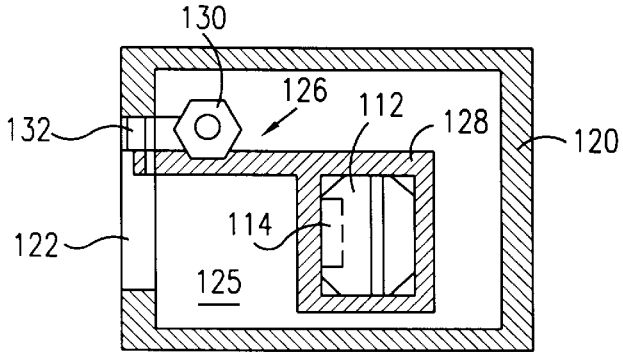
FIG. 2C
FIG. 3A
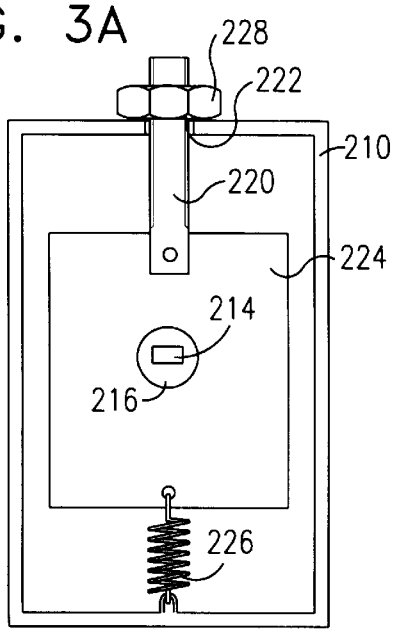
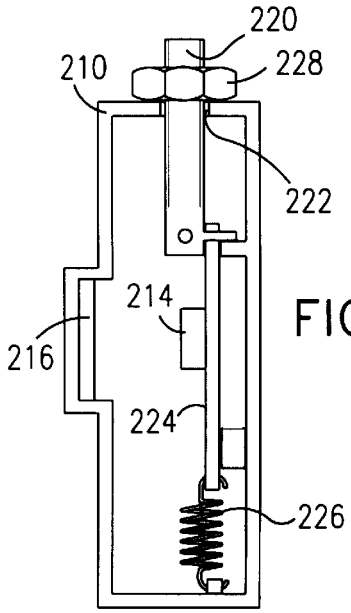
FIG. 3B

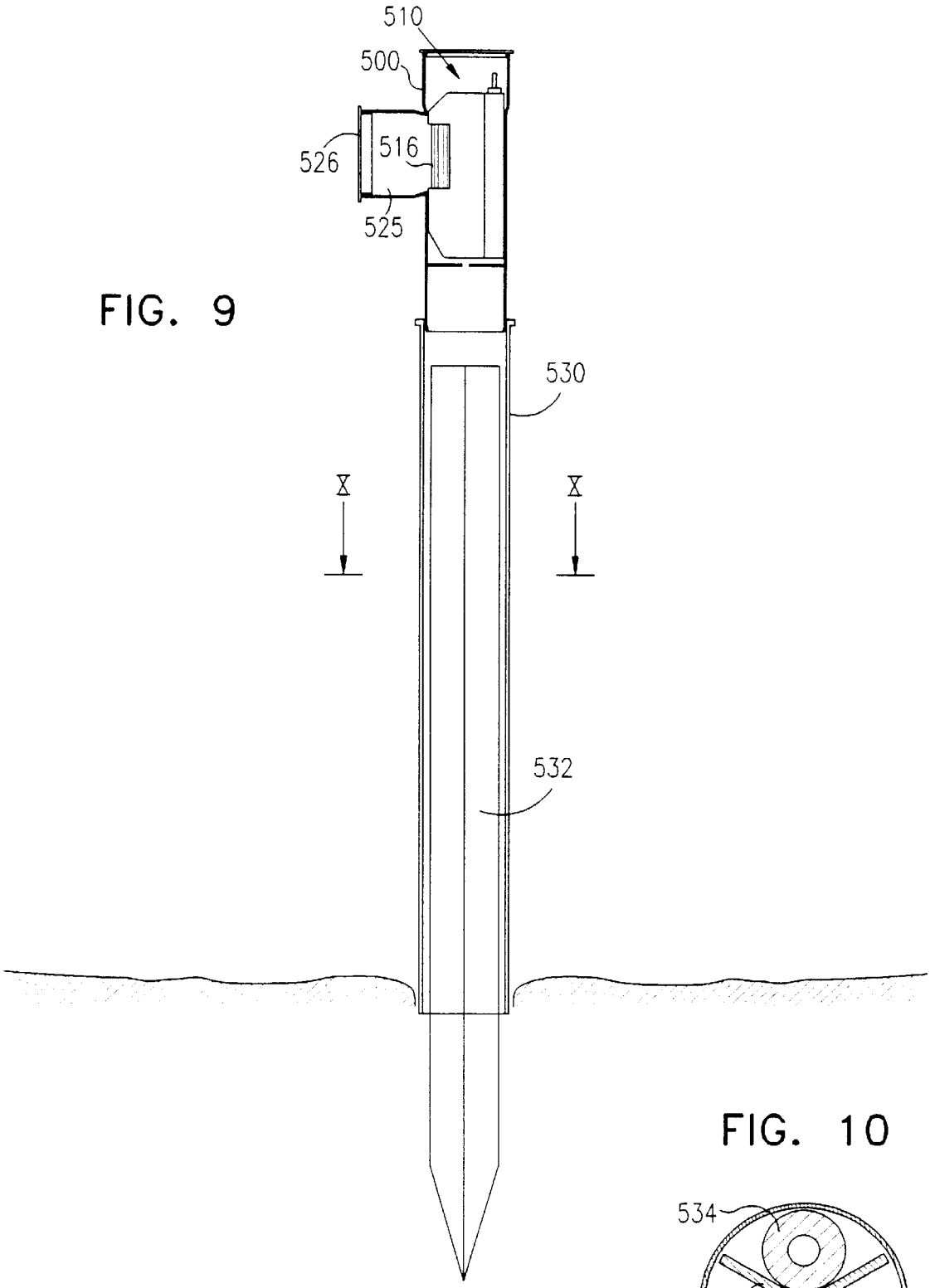
FIG. 9
FIG. 10
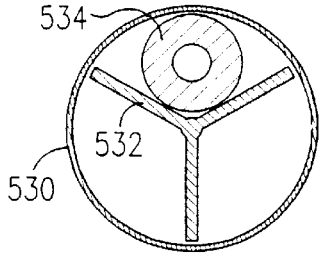

OUTDOOR INTRUSION DETECTOR

FIELD OF THE INVENTION

The present invention relates to intrusion detection generally and more particularly to non-contact intrusion detection.

BACKGROUND OF THE INVENTION

Various types of intrusion detectors are presently used for non-contact intrusion detection. These include passive detectors, particularly passive infra-red detectors, such as those described and claimed in the following U.S. Pat. Nos. 4,258,255; 4,447,726; 4,484,075; 4,604,524; 4,709,153; 4,725,768; 4,242,669; 4,982,094; 5,084,696; 5,077,549.

Active detectors, which generate a radiation beam and sense the presence or absence of reflection thereof are also employed for this purpose.

Passive infra-red detectors, whose use is extremely widespread for indoor applications have not been successfully employed in outdoor applications. A principle reason is that the region relatively close to the detector is extremely sensitive to spurious inputs, such as temperature changes, wind, rain, hail, birds and other creatures, producing an unacceptable false alarm rate.

Both active and passive non-contact detectors have the disadvantage for outdoor applications that they are normally readily noticeable and thus are subject to vandalism, rendering them wholly or partially inoperative.

SUMMARY OF THE INVENTION

The present invention seeks to provide apparatus and a method for conveniently employing non-contact intrusion detectors in a non-enclosed environment.

There is thus provided in accordance with a preferred embodiment of the present invention an intrusion detection assembly including an intrusion detector including an inner housing, a detector disposed within the inner housing and a lens for focusing light from outside the inner housing onto the detector, and an outer housing which is generally sealed from the outside and defines a window which is generally transparent to light which is detected by the detector, wherein the intrusion detector is spaced from the window so as to define a region of high sensitivity between the lens and the window which is sealed from the outside environment.

There is also provided in accordance with a preferred embodiment of the present invention an intrusion detection method including providing an intrusion detector including an inner housing, a detector disposed within the inner housing and a lens for focusing light from outside the inner housing onto the detector; and locating the intrusion detector within an outer housing which is generally sealed from the outside and defines a window which is generally transparent to light which is detected by the detector, wherein the intrusion detector is spaced from the window so as to define a region of high sensitivity between the lens and the window which is sealed from the outside environment.

In accordance with a preferred embodiment of the present invention, the intrusion detector is a self-contained intrusion detector.

Preferably, the intrusion detector has wireless communication capabilities, enabling it to communicate with remote alarm generating circuitry in a wireless manner.

In accordance with a preferred embodiment of the present invention, the intrusion detector is battery operated, obviating the need for a wired power connection thereto.

A preferred embodiment of the present invention employs a passive infrared detector which is disposed within an outer housing commonly used as a light housing, so that the presence of the passive infrared detector is not readily ascertained by unauthorized persons. The light housing, may or may not include a light source.

Alternatively, any suitable type of intrusion detector may be located in an outer housing which camouflages the presence of the intrusion detector.

In accordance with a preferred embodiment of the present invention, a photosensor may be located within the outer housing for sensing ambient light levels and automatically actuating the intrusion detector when the ambient light falls below a predetermined threshold.

Additionally in accordance with a preferred embodiment of the present invention, a vibration sensor may be located within or associated with the outer housing for sensing attempted tampering with the intrusion detection assembly and providing an alarm indication thereof.

Further in accordance with a preferred embodiment of the present invention multiple intrusion detection assemblies may be provided with at least partially overlapping regions of protection, at least two of the intrusion detection assemblies operating at different radiation frequencies which are ANDed to provide a highly false alarm resistant intrusion indication.

In accordance with a preferred embodiment of the present invention, the intrusion detector is capable of activating a cellular telephone, either directly via a wired connection, or indirectly by activating electric circuitry, which then activates the cellular telephone.

Alternatively, the intrusion detector may have wireless communication capabilities, enabling it to communicate with a receiver, which would then activate the cellular telephone, either through direct connection, or indirectly through electric circuitry.

BRIEF DESCRIPTION OF THE DRAWINGS

The present invention will be understood and appreciated more fully from the following detailed description, taken in conjunction with the drawings in which:

FIGS. 2A, 2B and 2C are respective front, side sectional and horizontal sectional illustrations of an alternative embodiment of intrusion detection assembly constructed and operative in accordance with a preferred embodiment of the present invention;

FIGS. 3A and 3B are simplified front sectional and side sectional illustrations of an intrusion detector useful in accordance with a preferred embodiment of the present invention;

FIG. 9 is a partially cut-away side view illustration of an intrusion detection assembly constructed and operative in accordance with an alternative embodiment of the present invention;

FIG. 10 is a sectional illustration, taken at lines X—X in FIG. 9;

DETAILED DESCRIPTIONS OF PREFERRED EMBODIMENTS

Figure 1:
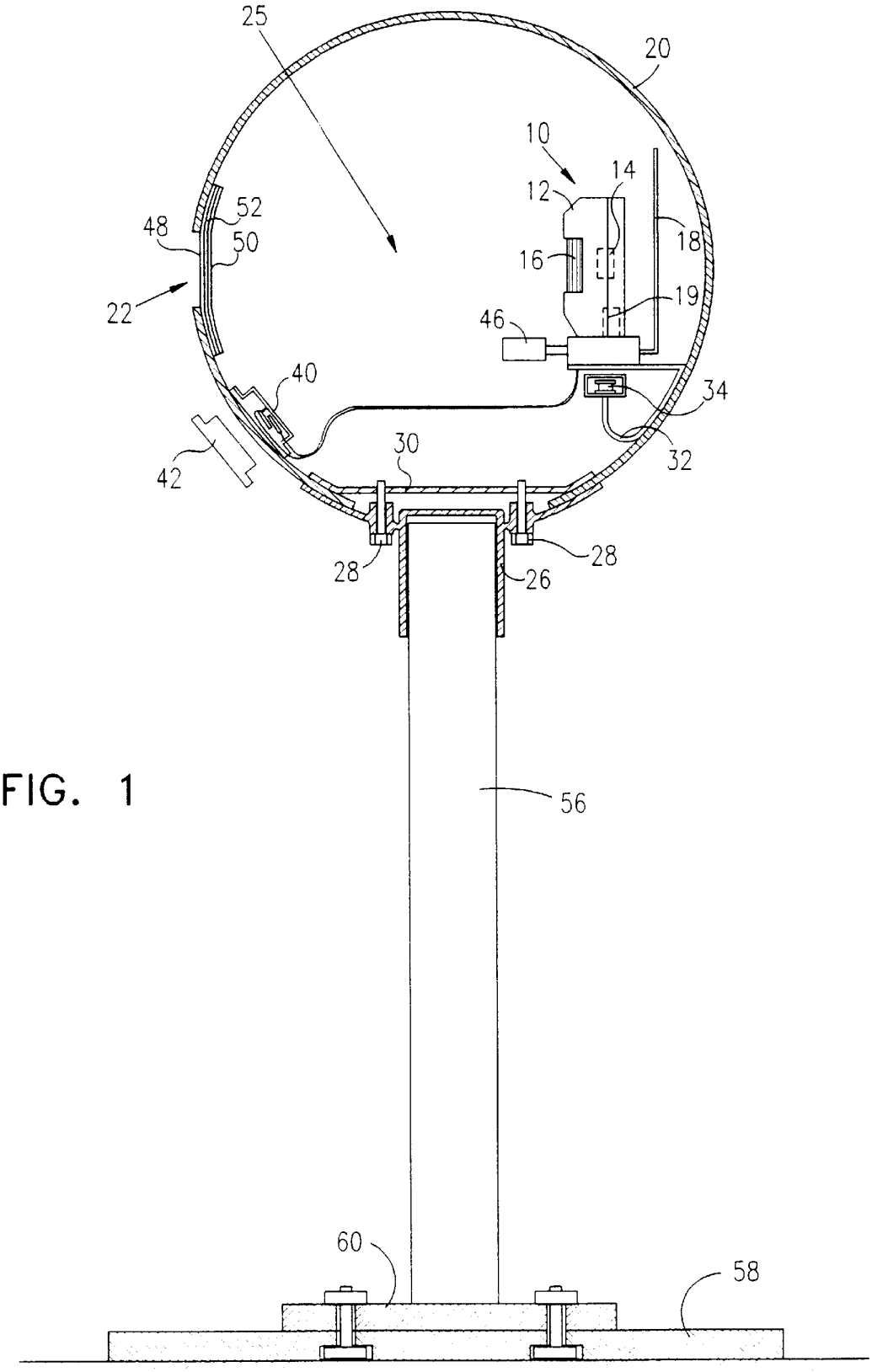
FIG. 1 is a simplified sectional illustration of an intrusion detection assembly constructed and operative in accordance with a preferred embodiment of the present invention.

Reference is now made to FIG. 1, which illustrates an intrusion detection assembly constructed and operative in accordance with a preferred embodiment of the present invention. The embodiment of FIG. 1 employs a conventional intrusion detector 10, preferably a passive infra-red detector, such as a SRN-2000W wireless PIR, commercially available from Visonic Ltd. of Tel Aviv, Israel.

Intrusion detector 10 comprises a housing 12, here termed an inner housing, a detector 14 disposed within the inner housing and a lens 16 for focusing light from outside the inner housing 12 onto the detector 14. An antenna 18 provides communication between the intrusion detector 10 and remote control and/or alarm generating apparatus (not shown). Preferably, intrusion detector 10 is powered by an internal battery 19.

In accordance with a preferred embodiment of the present invention, the intrusion detector 10 is placed within an outer housing 20, here a housing conventionally used for an outdoor light, which is generally sealed from the outside and defines a window 22 which is generally transparent to light which is detected by the detector 14.

It is a particular feature of the present invention that the intrusion detector 10 is spaced from the window 22 so as to define a region of high sensitivity, indicated generally by reference numeral 25 between the lens 16 and the window 22 which is sealed from the outside environment and thus is not normally affected by spurious events which otherwise could give rise to false alarms in an outdoor environment.

In the illustrated embodiment of FIG. 1, the outer housing 20 is of generally spherical shape and is mounted onto a base 26 by means of adjustment screws 28 which engage a mounting engagement plate 30. This arrangement preferably provides selectable angle and azimuth mounting of detector 14 relative to window 22 such that detector 14 sees a desired protected region via lens 16 and window 22.

The intrusion detector 10 is typically mounted onto a mounting bracket 32, which is in turn mounted on housing 20 and may be provided with a conventional vibration sensitive tamper switch 34 for providing an alarm indication if an attempt is made to vandalize or even move the intrusion detection assembly. The tamper switch 34 is preferably wired to the circuitry of the intrusion detector 10 so as to provide a tamper alarm indication via antenna 18 and remote alarm generating circuitry.

Correct aiming of the intrusion detector 10 may be confirmed by conducting a conventional walk test. This may be initiated by operating the intrusion detector 10 in a test mode. Preferably a test mode switch 40, such as a magnetically operated reed switch, is provided and may actuated by a magnet 42 which may be brought into propinquity therewith at the outside of housing 20.

Additionally in accordance with a preferred embodiment of the present invention a photocell 46 may be provided for actuating the intrusion detector 10 only at nightfall, when the ambient light sensed by the photocell 46 falls below a selected threshold. This selective operation of the intrusion detector 10 saves considerable battery power and thus extends the maintenance free operation of the system.

Window 22 is preferably formed of a pair of screens 48 and 50 which provide mechanical strength and protection for an optical filter 52, which preferably only passes IR frequencies sensed by detector 14.

Figure 4:
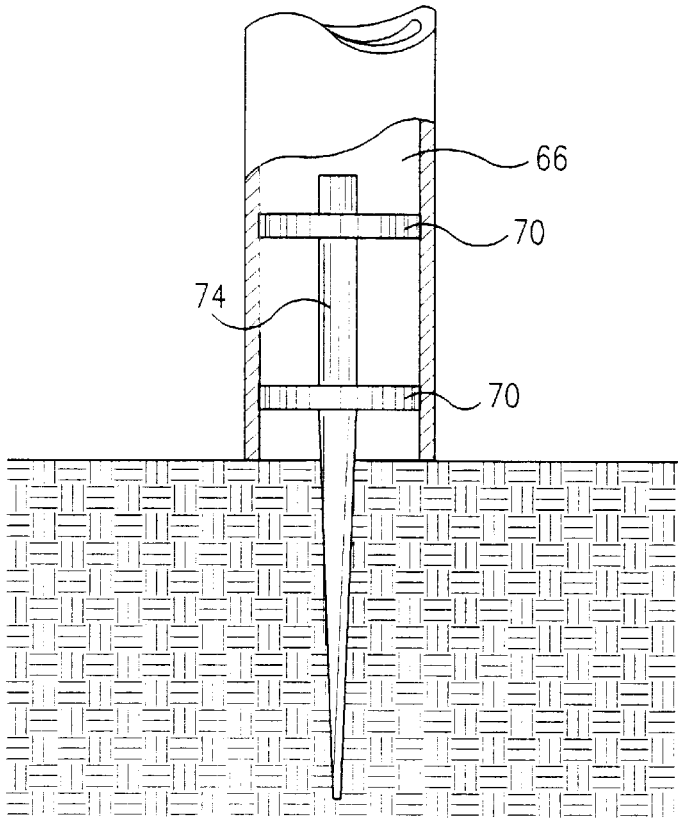
FIGS. 4 and 5 are illustrations of two alternative mounting arrangements useful with the intrusion detection assemblies of the present invention.
Figure 5:
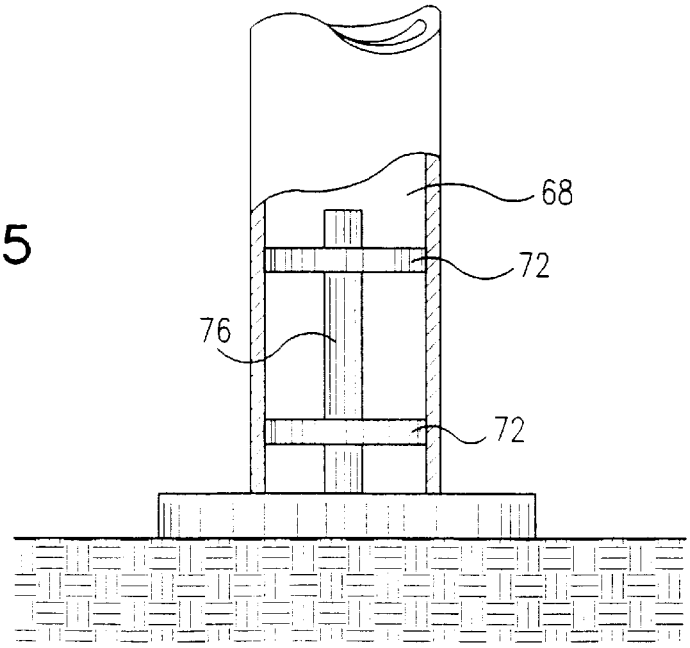

Base 26 may be mounted onto a post 56, which may be attached to a base 58, as by means of a flange 60, fixed to post 56, which is bolted onto base 58. Alternatively, the post may be frictionally mounted onto a stake as illustrated in FIG. 4 or a base as shown in FIG. 5, by means of an internal mounting arrangement wherein tight frictional engagement with the inside surface of respective hollow shafts 66 and 68 is provided by respective engagement members 70 and 72 respectively mounted onto respective shafts 74 and 76.

Reference is now made to FIGS. 2A, 2B and 2C, which are respective front, side sectional and horizontal sectional illustrations of an alternative embodiment of intrusion detection assembly constructed and operative in accordance with a preferred embodiment of the present invention. The embodiment of FIGS. 2A–2C also preferably employs a conventional intrusion detector 110, preferably a passive infra-red detector, such as a SRN-2000W wireless PIR, commercially available from Visonic Ltd. of Tel Aviv, Israel.

Similarly to intrusion detector 10 in the embodiment of FIG. 1, intrusion detector 110 comprises a housing 112, here termed an inner housing, a detector 114 disposed within the inner housing and a lens 116 for focusing light from outside the inner housing 112 onto the detector 114. An antenna 118 provides communication between the intrusion detector 110 and remote control and/or alarm generating apparatus (not shown). Preferably, intrusion detector 110 is powered by an internal battery 119.

In the embodiment of FIGS. 2A–2C, the intrusion detector 110 is placed within an outer housing 120, here shown as a generally rectangular box in order to represent any suitable housing of any suitable shape, preferably a conventional shape which does not indicate to an intruder that an intrusion detection system is in place. Outer housing 120 is generally sealed from the outside and defines a window 122 which is generally transparent to light which is detected by the detector 114.

It is also a particular feature of the embodiment of FIGS. 2A–2C that the intrusion detector 110 is spaced from the window 122 so as to define a region of high sensitivity, indicated generally by reference numeral 125 between the lens 116 and the window 122 which is sealed from the outside environment and thus is not normally affected by spurious events which otherwise could give rise to false alarms in an outdoor environment.

In the embodiment of FIGS. 2A–2C, there is provided an articulated mounting assembly 126 including a pivotably mounted mounting bracket 128 supporting the intrusion detector 110, a screw positioner 130 engaging a threaded socket associated with mounting bracket 128 and a mounting support 132 supporting the screw positioner 130. This arrangement preferably provides selectable angle and azimuth mounting of detector 114 relative to window 122 such that detector 114 sees a desired protected region via lens 116 and window 122.

A conventional vibration sensitive tamper switch (not shown) may be provided, as in the embodiment of FIG. 1, for providing an alarm indication if an attempt is made to vandalize or even move the intrusion detection assembly. The tamper switch is preferably wired to the circuitry of the intrusion detector 110 so as to provide a tamper alarm indication via antenna 118 and remote alarm generating circuitry.

Correct aiming of the intrusion detector 110 may be confirmed by conducting a conventional walk test. This may be initiated by operating the intrusion detector 110 in a test mode. Preferably a test mode switch (not shown), such as a magnetically operated reed switch, is provided and may actuated by a magnet (not shown) which may be brought into propinquity therewith at the outside of housing 120.

Additionally in accordance with a preferred embodiment of the present invention a photocell (not shown) may be provided for actuating the intrusion detector 110 only at nightfall, as in the embodiment of FIG. 1.

As in the embodiment of FIG. 1, window 122 is preferably formed of a pair of screens which provide mechanical strength and protection for a optical filter, which preferably only passes those frequencies sensed by detector 114.

Outer housing 120 may be mounted onto a post, which may be attached to a base or a stake in any suitable manner, such as that illustrated in FIGS. 4 and 5.

Reference is now made to FIGS. 3A and 3B, which are simplified front sectional and side sectional illustrations of an intrusion detector useful in accordance with a preferred embodiment of the present invention. The intrusion detector of FIGS. 3A and 3B has a detector 214 which is readily vertically adjustable from outside the intrusion detector housing 210.

This adjustability is effected by means of a screw 220 which engages a threaded socket 222 in housing 210 and is fixed to a printed circuit board 224 which supports, inter alia, detector 214. The printed circuit board 224 is also mounted by means of a tension spring 226 onto the bottom of housing 210, such that adjustment of the position of screw 220 determines the vertical position of detector 214 relative to housing 210 and to lens 216. The position of screw 220 relative to socket 222 may be changeably fixed by tightening a retaining nut 228 in engagement with screw 220 onto socket 222.

An intrusion detector of the type shown in FIGS. 3A and 3B may be employed in the embodiments of FIGS. 1 and 2A–2C. When employed in an embodiment similar to that of FIGS. 2A–2C, the positioning assembly 126 may be obviated, inasmuch as positioning of the detector may be readily achieved from outside the inner housing of the intrusion detector.

Figure 6:
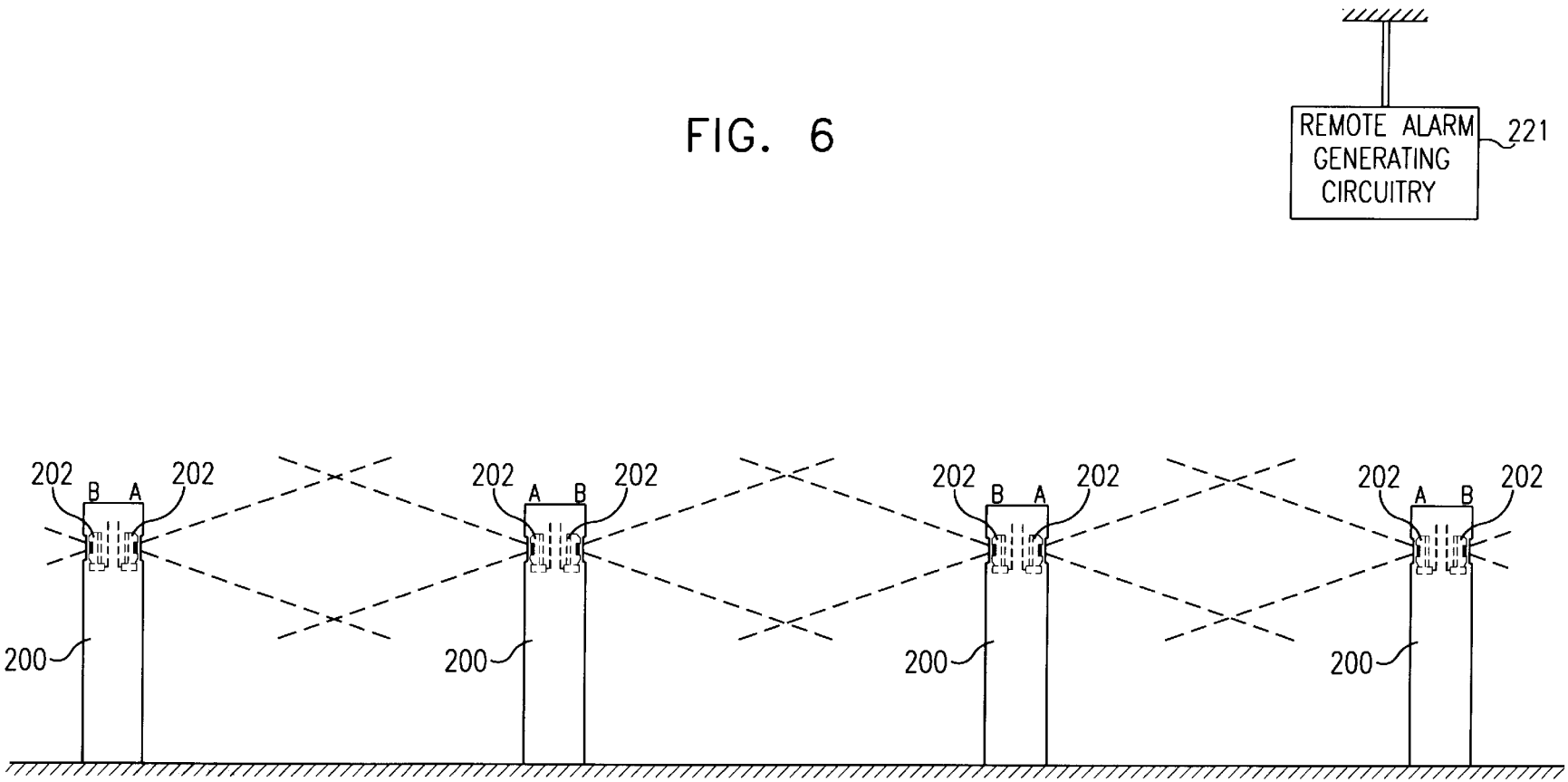
FIG. 6 is a simplified illustration of an intrusion detection system constructed and operative in accordance with a preferred embodiment of the present invention.

Reference is now made to FIG. 6, which illustrates an intrusion detection system comprising multiple intrusion detection assemblies having at least partially overlapping regions of protection, at least two of the intrusion detection assemblies operating at different radiation frequencies which are ANDed to provide a highly false alarm resistant intrusion indication. Preferably, but not necessarily, the intrusion detection assemblies are constructed and operative as described in accordance with the foregoing description taken in conjunction with one or more of FIGS. 1–5.

In the illustrated embodiment, a plurality of intrusion detection modules 200 are provided, each preferably including at least two intrusion detection assemblies 202, preferably of the type described hereinabove in connection with any of FIGS. 1–3B. In accordance with a preferred embodiment of the present invention, plural regions of interest are monitored by at least two intrusion detection assemblies 202 operating at different frequencies, each of which communicate with remote alarm generating circuitry 221, preferably in a wireless manner.

Circuitry 221 preferably includes AND circuitry which receives inputs from plural intrusion detection assemblies monitoring a given region of interest and ANDs them together, so as to provide an alarm indication only when at least two intrusion detection assemblies operating at at least two different frequencies indicate intrusion. In this way, a very low false alarm rate may be achieved.

It is a particular feature of the present invention that when the system of FIG. 6 employs the intrusion detection assemblies of any of FIGS. 1–3B, substantially lowered false alarm rates are achieved, which enables the system to be used in outdoor applications wherein false alarm tolerance is extremely low.

Reference is now made to FIGS. 7A, 7B, 8A and 8B, which illustrate various modes of connecting the intrusion detection assemblies with a cellular telephone, to be activated upon detection of an intrusion. Preferably, but not necessarily, the intrusion detection assemblies are constructed and operative as described in accordance with the foregoing description taken in conjunction with one or more of FIGS. 1–5.

Figure 7A:
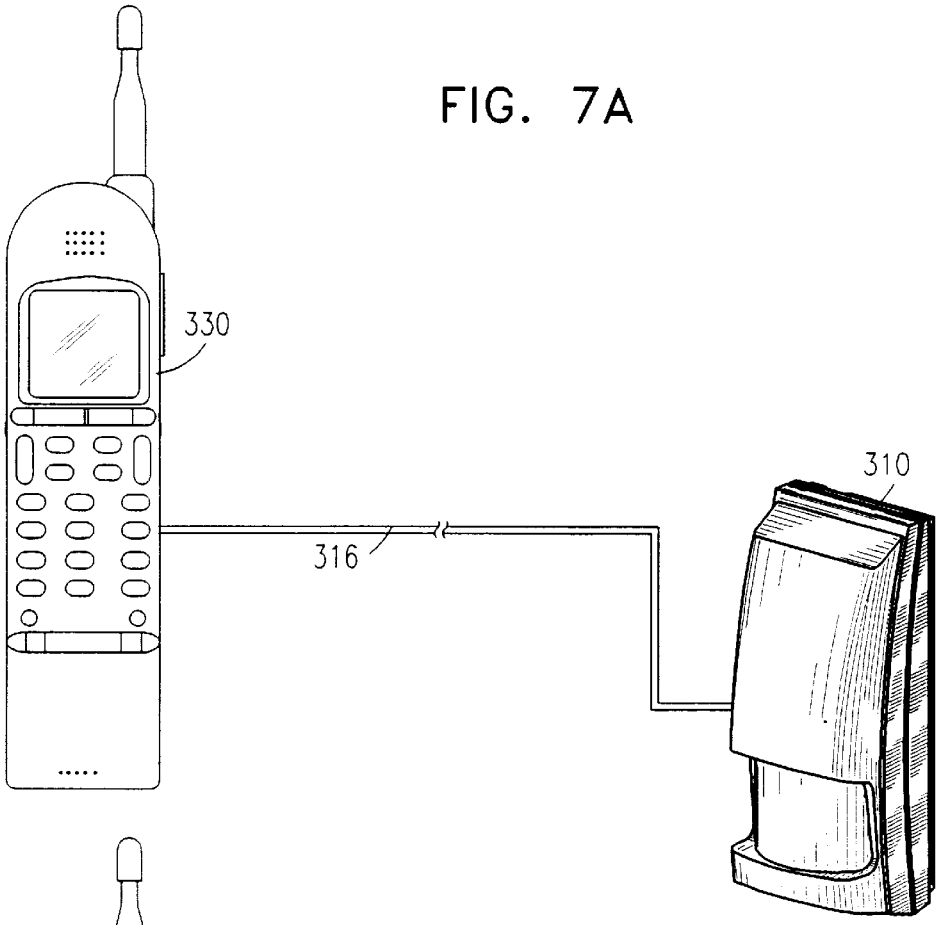
FIG. 7A, 7B, 8A and 8B are simplified illustrations of four alternative arrangements for connecting the intrusion detection assemblies of the present invention with a cellular telephone.
Figure 7B:
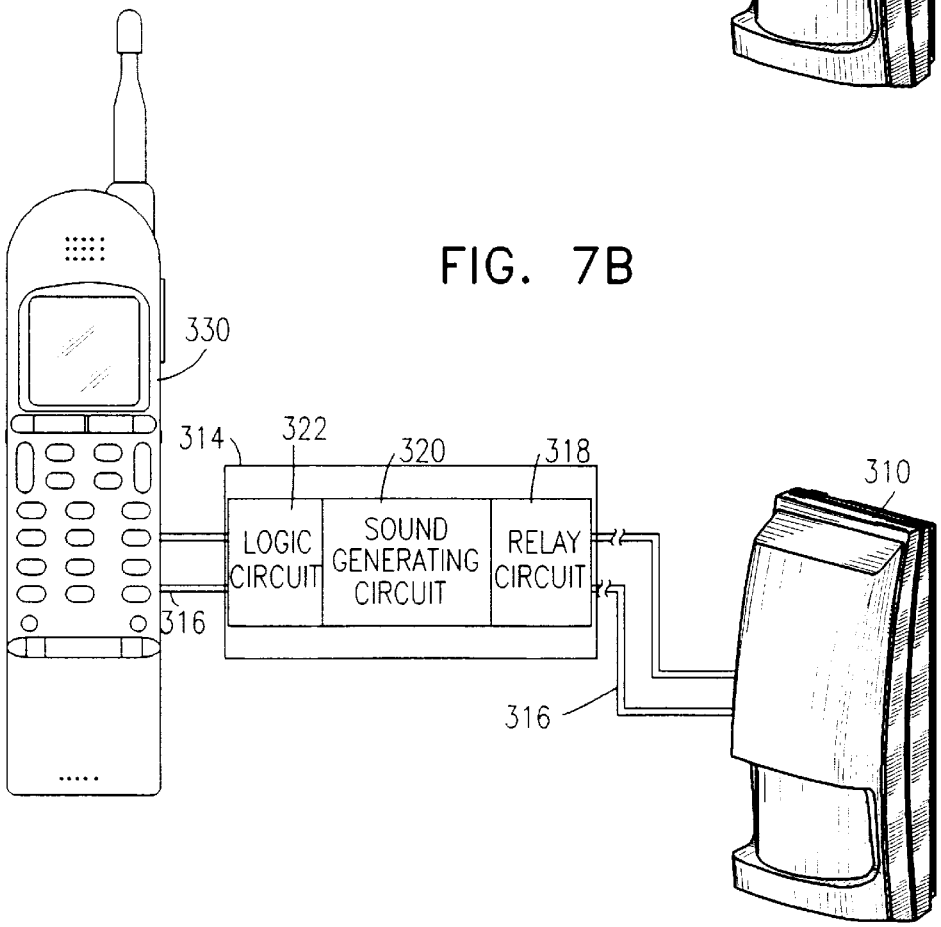

In the illustrated embodiment of FIG. 7A, an intrusion detector 310 directly activates a cellular telephone 330, via a wired connection 316. As illustrated in FIG. 7B, intrusion detector 3 10 may alternatively indirectly activate cellular telephone 330, via electric circuitry 314. Electric circuitry 314 preferably includes one or more of the following circuits: a relay circuit 318, a sound generating circuit 320, and a logic circuit 322.

Upon detection of an intrusion, intrusion detector 310 activates cellular telephone 330, either directly via wired connection 316, or indirectly passing through electric circuitry 314. Cellular telephone 330 then dials at least one preprogrammed telephone number, and when the call is answered, activates an alarm or a recorded voice message, generated by the sound generating circuit 320.

Figure 8A:
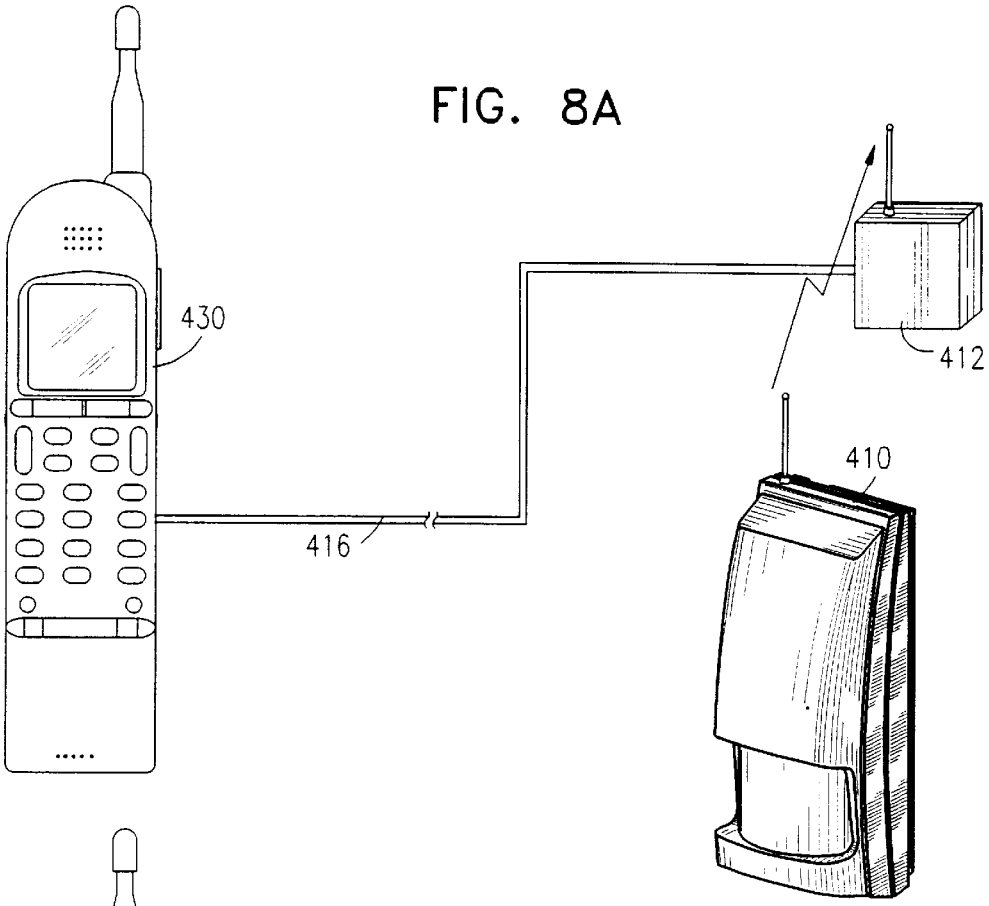
Figure 8B:
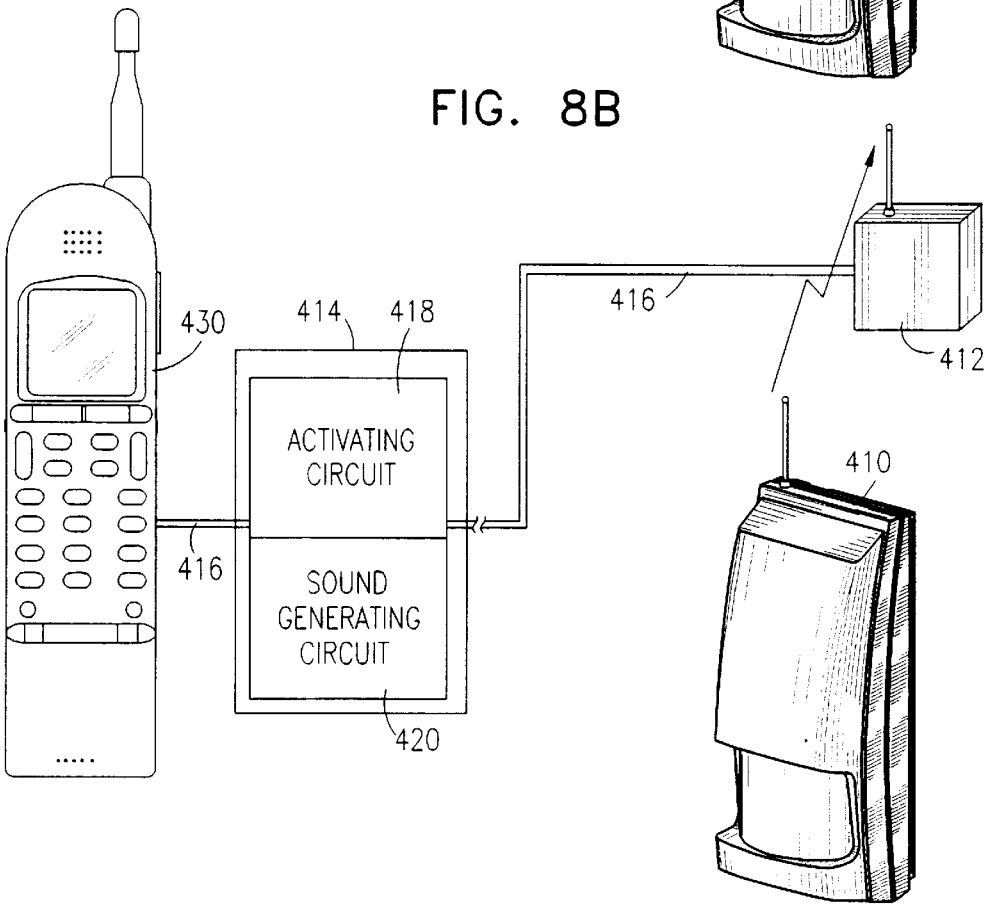

In the embodiments of FIGS. 8A and 8B, an intrusion detector 410 has wireless communication capabilities, enabling it to communicate with a receiver 412, which then activates a cellular telephone 430. In the illustrated embodiment of FIG. 8A, receiver 412 directly activates cellular telephone 430, via wired connection 416. As illustrated in FIG. 8B, receiver 412 may alternatively indirectly activate cellular telephone 430, via electric circuitry 414. Electric circuitry 414 preferably includes one or more of the following circuits: an activating circuit 418, and a sound generating circuit 420.

Upon detection of an intrusion, intrusion detector 410 transmits an alarm signal to receiver 412. Receiver 412 then activates cellular telephone 430, either directly via wired connection 416, or indirectly passing through electric circuitry 414. Cellular telephone 430 then dials at least one preprogrammed telephone number, and when the call is answered, activates an alarm or a recorded voice message, generated by the sound generating circuit 420.

Reference is now made to FIG. 9, which is a partially cut-away side view illustration of an intrusion detection assembly constructed and operative in accordance with an alternative embodiment of the present invention and to FIG. 10, which is a sectional illustration, taken at lines X—X in FIG. 9.

The embodiment of FIG. 9 may be similar in all relevant respects to that of FIG. 1 other than in that it need not be embodied in a generally spherical housing, as in the embodiment of FIG. 1. In the embodiment of FIG. 9, a T-shaped pipe coupler 500 houses an intrusion detector 510, the structure and operation of which may be identical to that of intrusion detector 10 in the embodiment of FIG. 1 and includes a lens 516. A region of high sensitivity, indicated generally by reference numeral 525 is defined between lens 516 and a window 526 defined by pipe coupler 500.

Figure 14A:
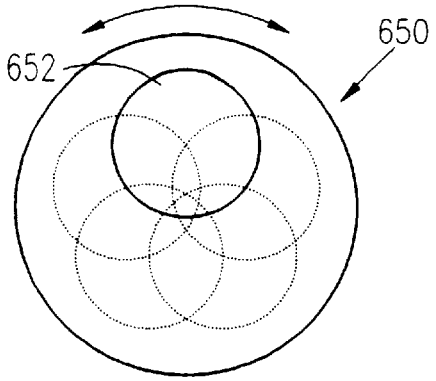
FIGS. 14A, 14B and 14C are illustrations of three alternative iris arrangements useful in various embodiments of the present invention.
Figure 14B:
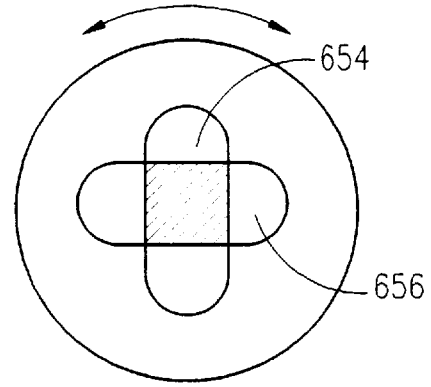
Figure 14C:
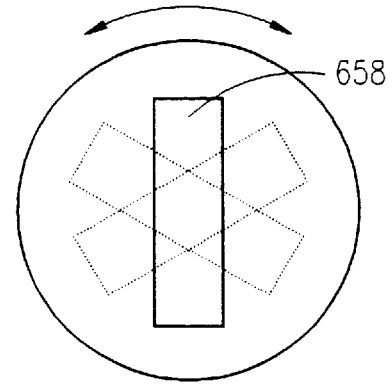

Window 526 may be identical to window 22 in the embodiment of FIG. 1 and may additionally be provided with a rotationally orientable iris assembly such as an assembly of the type illustrated in any of FIGS. 14A–14C.

Pipe coupler 500 may be sealingly mounted onto an elongate cylindrical support 530, which may be in turn mounted onto a stake 532. FIG. 10 shows a particularly convenient way of securing the cylindrical support 530 and the stake together, through the use of a resilient tube 534 which is interposed between the stake and the cylindrical support 530.

Figure 11:
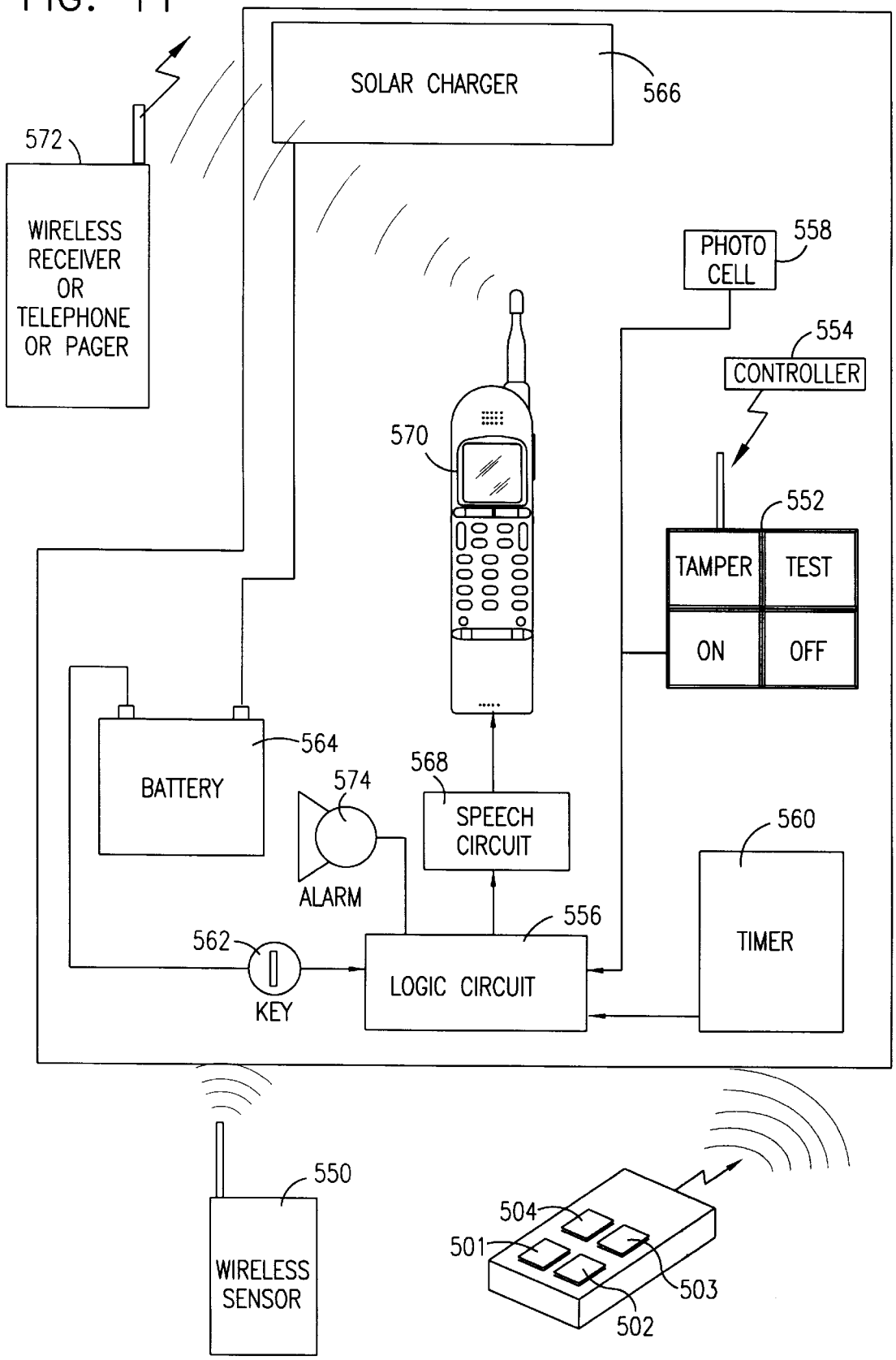
FIG. 11 is a simplified block diagram illustration of an intrusion detection assembly constructed and operative in accordance with a further alternative embodiment of the present invention.

Reference is now made to FIG. 11, which is a simplified block diagram illustration of an intrusion detection assembly constructed and operative in accordance with a further alternative embodiment of the present invention. The assembly of FIG. 11 comprises a wireless sensor 550 of the type described hereinabove in the embodiment of FIG. 9 or any of the other embodiments of the present invention. Wireless sensor may be fixed or movable and may be at a fixed location or alternatively in a vehicle to be protected.

Sensor 550 provides a wireless output indication of intrusion to an interface circuit 552, which also receives control inputs from a wireless controller 554, typically having ON, OFF, TEST and TAMPER DETECT features, designated by reference numerals 501, 502, 503 and 504, respectively.

An indication of intrusion or of tampering is supplied via interface 552 to a logic circuit 556, which also may receive an input from a photocell 558, indicating ambient light or darkness and/or from a timer 560. The logic circuit 556 may also be actuated via a key 562 which may control the supply of electric power thereto from a battery 564, which may be recharged by a solar charger 566.

Upon sensing intrusion or tampering the logic circuit 556 provides an actuation output to a speech circuit 568 which provides an appropriate speech output and dialing instructions to a conventional cellular telephone 570. The alarm output of cellular telephone 570 may be received at any desired remote location by means of a telephone, pager or other wireless or wired link 572. Alternatively, logic circuit 556 may actuate an alarm 574.

Figure 12:
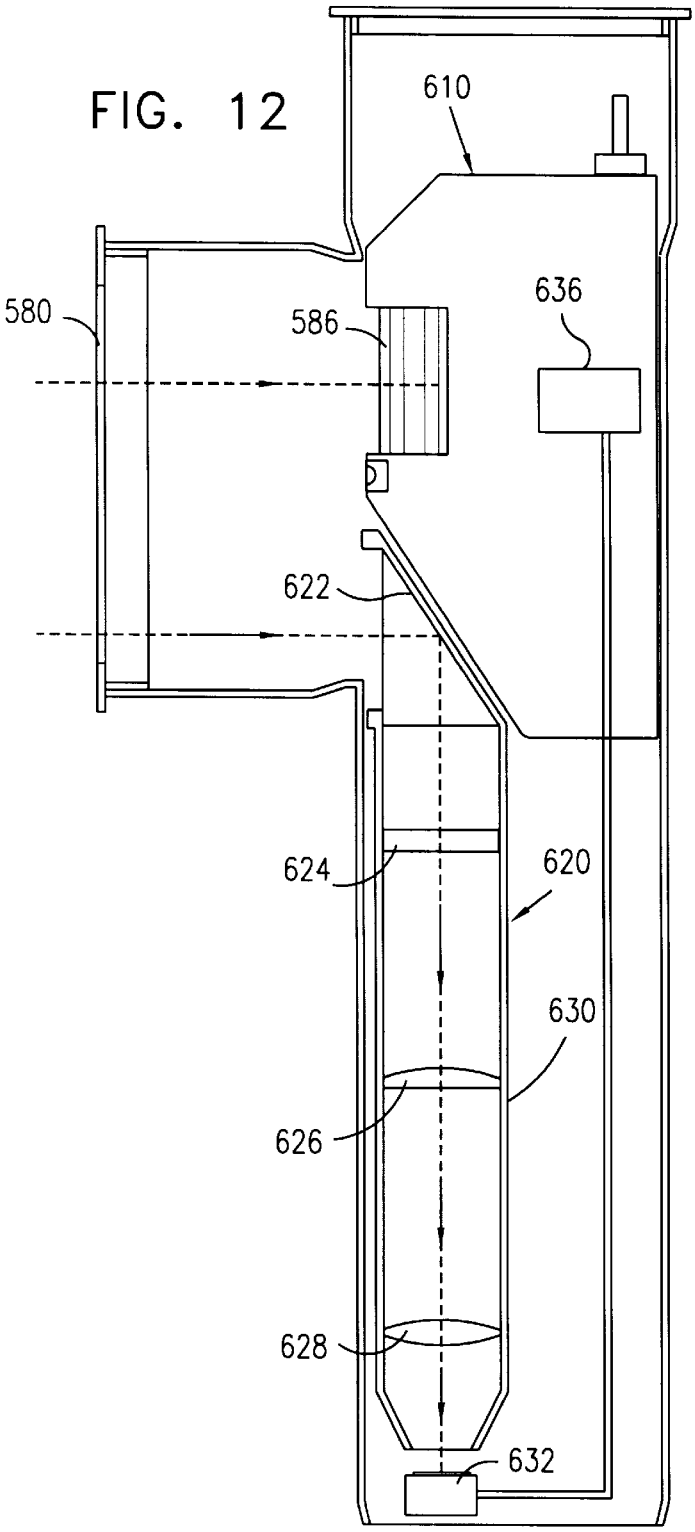
FIG. 12 is a partially cut-away pictorial illustration of an intrusion detection assembly constructed and operative in accordance with yet another alternative embodiment of the present invention.
Figure 13:
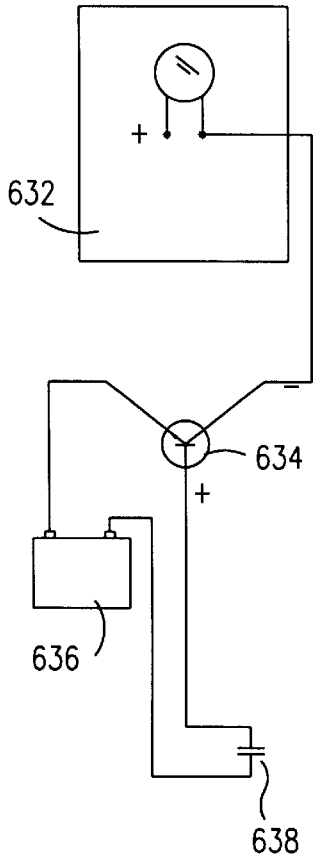
FIG. 13 is an illustration of circuitry useful in the embodiment of FIG. 12.

Reference is now made to FIG. 12, which is a partially cut-away pictorial illustration of an intrusion detection assembly constructed and operative in accordance with yet another alternative embodiment of the present invention and to FIG. 13, which is an illustration of circuitry useful in the embodiment of FIG. 12. The embodiment of FIG. 12 is a variation on the embodiment of FIG. 9 wherein light incoming through a window 580 is directed not only through a lens 586 of an intrusion sensor 610 but also via a telescopic periscope 620 comprising a mirror 622 and various lenses, such as lenses 624, 626 and 628 supported on a housing 630 onto a photosensor 632.

As seen in FIG. 13, the output of photosensor 632 typically operates a transistor 634, powered by a battery 636, for charging a capacitor 638, thus powering the intrusion sensor 610.

FIGS. 14A, 14B and 14C are illustrations of three alternative iris arrangements useful in windows of various embodiments of the present invention, including the embodiments of FIGS. 9, 11 and 12. The embodiment of FIG. 14A includes an iris 650 with a single, off-axis opening 652 which can be positioned by rotation, as shown. The embodiment of FIG. 14B, comprises a pair of mutually overlaid elongate irises 654 and 656, each which are rotatable such that they can provide an opening of desired size and orientation. FIG. 14C shows a single elongate iris 658 which is selectably oriented by rotation as shown.

Figure 15A:
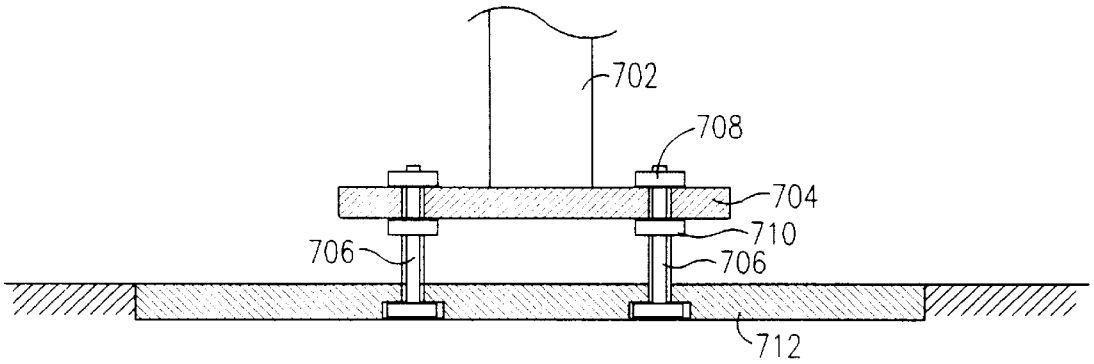
FIGS. 15A and 15B are illustrations of two alternative mounting arrangements for intrusion detection assemblies of the present invention.
Figure 15B:
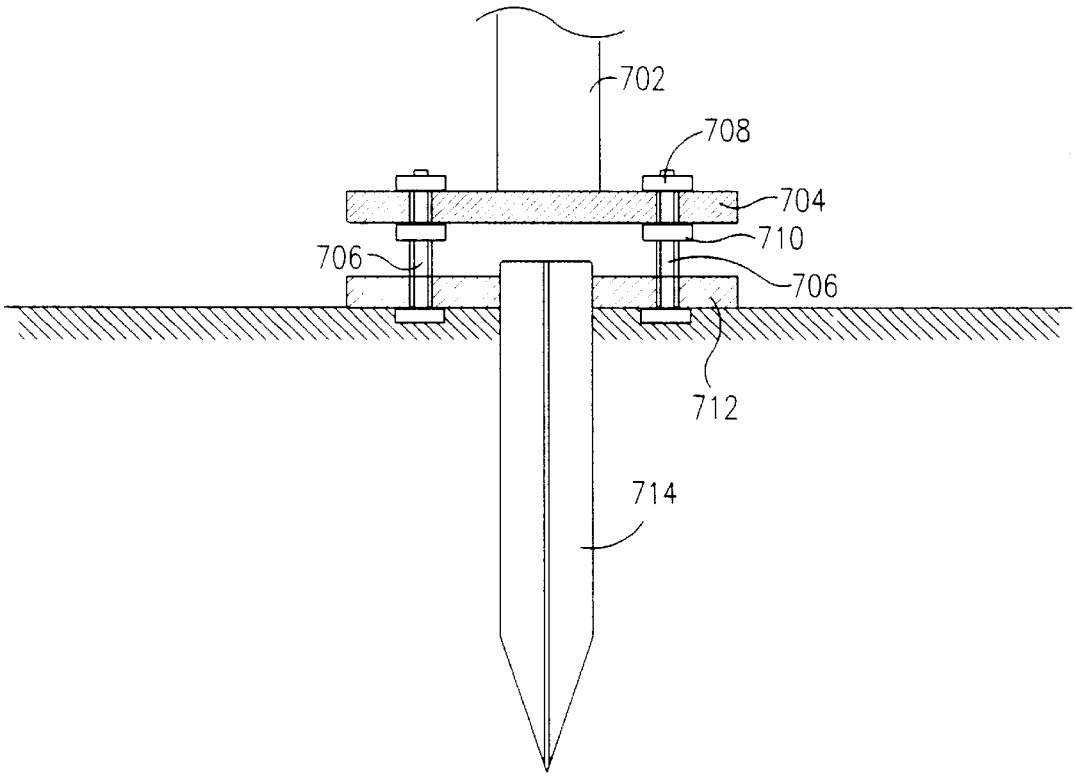

Reference is now made to FIGS. 15A and 15B are illustrations of two alternative mounting arrangements for intrusion detection assemblies of the present invention. In both orientations, an intrusion detection device (not shown) is mounted on a shaft 702, the orientation of which is determined by suitably positioning a base plate 704 fixed thereto on a plurality of upstanding screws 706, using pairs of nuts 708 and 710, as shown. In the embodiment of FIG. 15A, the screws are anchored in a support plate 712 which is recessed in a support surface and in the embodiment of FIG. 15B, the support plate 712 is associated with a stake 714.

Figure 16:
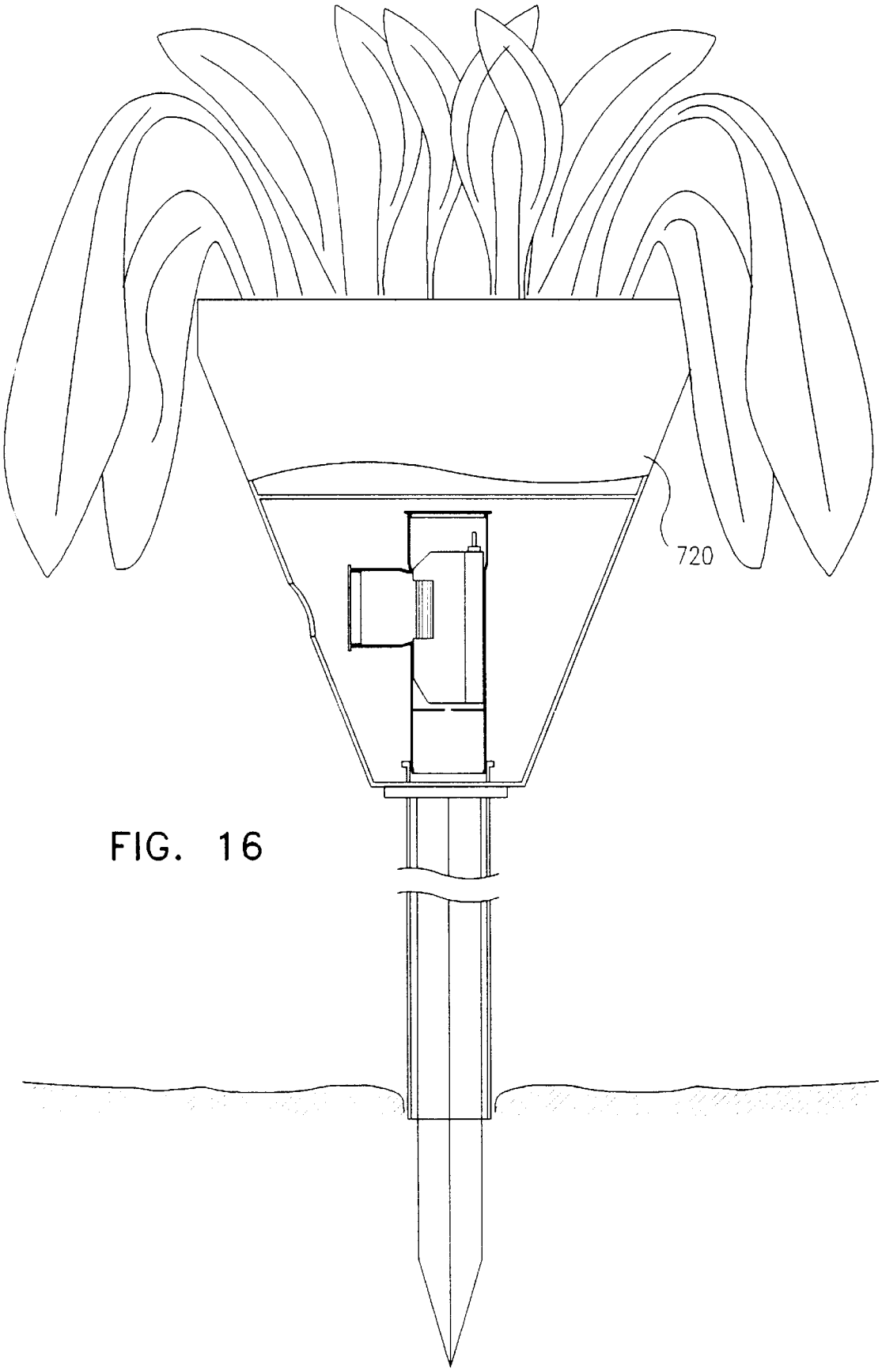
FIG. 16 is a partially cut-away pictorial illustration of an intrusion detection assembly constructed and operative in accordance with still another alternative embodiment of the present invention.

Reference is now made to FIG. 16, which is a partially cut-away pictorial illustration of an intrusion detection assembly constructed and operative in accordance with still another alternative embodiment of the present invention. The embodiment of FIG. 16 represents the incorporation of the embodiment of FIG. 9 into an ordinary looking planter 720.

Figure 17:
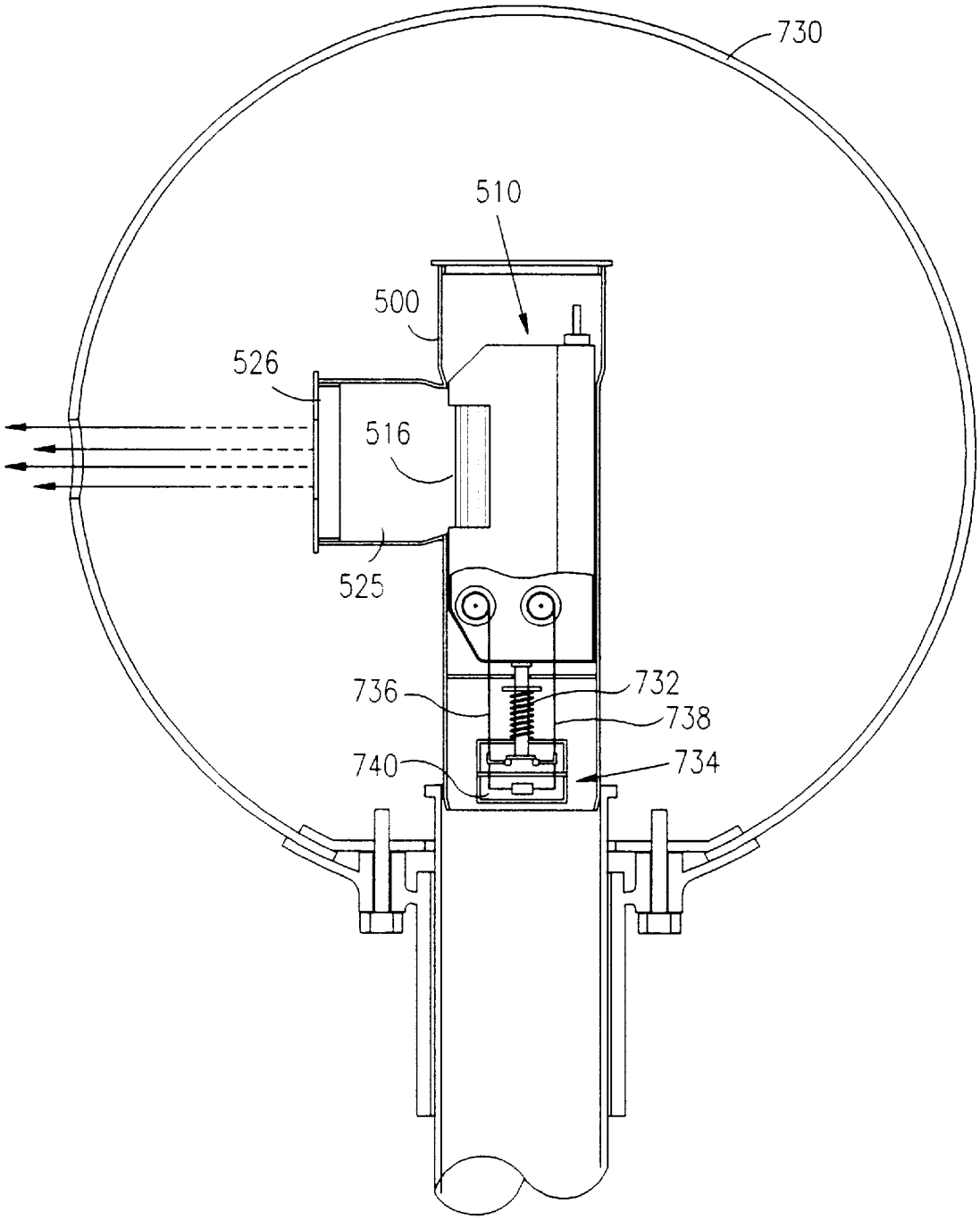
FIG. 17 is a partially cut-away pictorial illustration of an intrusion detection assembly constructed and operative in accordance with an embodiment of the present invention and including a tamper sensor.

Reference is now made to FIG. 17, which is a partially cut-away pictorial illustration of an intrusion detection assembly constructed and operative in accordance with an embodiment of the present invention and including a tamper sensor. The embodiment of FIG. 17 represents the incorporation of the embodiment of FIG. 9 into an ordinary light fixture 730. In this embodiment either one or both of a pair of tamper switches provide an alarm indication if an attempt is made to vandalize or even move the intrusion detection assembly. A first tamper switch 732 is preferably spring-loaded and provides a tamper alarm indication upon generally vertical movement of intrusion detector 510 beyond a predetermined limit. A mercury-switch tamper detection assembly 734 preferably includes a pair of leads 736 and 738 in a mercury bath 740. Tamper detection assembly 734 provides a tamper alarm indication upon generally angular or linear movement of intrusion detector 510 beyond a predetermined limit.

It will be appreciated by persons skilled in the art that the present invention is not limited by what has been particularly shown and described hereinabove. Rather the scope of the present invention includes both combinations and subcombinations of the various features described hereinabove as well as developments and modifications thereof which would occur to a person of skill in the art upon reading the foregoing description and which are not in the prior art.

What is claimed is:

1. An intrusion detection assembly including:

an intrusion detector including an inner housing, a detector disposed within the inner housing and a lens for focusing light from outside the inner housing onto the detector; and an outer housing which is generally sealed from the outside and defines a window which is generally transparent to light which is detected by the detector, wherein the intrusion detector is spaced from the window so as to define a region of high sensitivity between the lens and the window which is sealed from the outside environment, and wherein light incoming through said window is directed not only through said lens of said intrusion sensor but also via a telescopic periscope disposed in said outer housing.

2. An intrusion detection assembly including:

an intrusion detector including an inner housing, a detector disposed within the inner housing and a lens for focusing light from outside the inner housing onto the detector; and an outer housing which is generally sealed from the outside and defines a window which is generally transparent to light which is detected by the detector, wherein the intrusion detector is spaced from the window so as to define a region of high sensitivity between the lens and the window which is sealed from the outside environment, and wherein said window comprises an iris with a single, off-axis, rotatable opening.

3. An intrusion detection assembly including:

an intrusion detector including an inner housing, a detector disposed within the inner housing and a lens for focusing light from outside the inner housing onto the detector; and an outer housing which is generally sealed from the outside and defines a window which is generally transparent to light which is detected by the detector, wherein the intrusion detector is spaced from the window so as to define a region of high sensitivity between the lens and the window which is sealed from the outside environment, and wherein said window comprises a pair of mutually overlaid elongate irises.

4. An intrusion detection assembly including:

an intrusion detector including an inner housing, a detector disposed within the inner housing and a lens for focusing light from outside the inner housing onto the detector; and an outer housing which is generally sealed from the outside and defines a window which is generally transparent to light which is detected by the detector, wherein the intrusion detector is spaced from the window so as to define a region of high sensitivity between the lens and the window which is sealed from the outside environment, and wherein said window comprises an elongate, rotatable iris.

* * * * *